United States Patent [19]

Jouan et al.

[11] Patent Number: 5,058,392

[45] Date of Patent: Oct. 22, 1991

[54] AIR CONDITIONER HEATBOX

[76] Inventors: Cynthia Jouan; Marcel Jouan, both of 3530 Pansy Dr., Calabasas, Calif. 91302

[21] Appl. No.: 445,358

[22] Filed: Dec. 4, 1989

[51] Int. Cl.[5] ..... F25B 27/00

[52] U.S. Cl. ..... 62/238.6

[58] Field of Search ..... 62/238.6

[56] References Cited

U.S. PATENT DOCUMENTS

| | | | |
|---|---|---|---|
| 4,513,585 | 4/1985 | Maisonneuve | 62/238.6 |
| 4,558,571 | 12/1985 | Yoshinaga et al. | 62/238.6 |
| 4,558,818 | 12/1985 | Harnish | 62/238.6 X |
| 4,653,287 | 3/1987 | Martin, Jr. | 62/238.6 X |
| 4,823,557 | 4/1989 | Bottum, Jr. et al. | 62/238.6 |
| 4,852,366 | 8/1989 | Harris | 62/238.6 |
| 4,907,418 | 3/1990 | DeFazio | 62/238.6 |

*Primary Examiner*—Lloyd L. King

*Attorney, Agent, or Firm*—Michael I. Kroll

[57] ABSTRACT

A heatbox is disclosed. The heatbox comprises a compressor having a discharge valve and a suction valve, a housing having a top and a bottom on to which the compressor is disposed, a evaporizer having a bottom and a middle and being vertically disposed next to the compressor in the housing, a fourth loop pipe connecting the evaporizer to the suction valve of the compressor, a fan disposed in the housing opposite the evaporizer, a heat exchanger having an input valve and being disposed near the top of the housing, above the compressor and having a third loop pipe connecting the discharge valve of the compressor to the input valve of the heat exchanger, a water expansion valve, a dryer having a top and a bottom to which a first pipe runs while a second pipe runs from the top of the dryer to the expansion valve and a pair of fifth and sixth pipes connecting to the bottom and the middle of the evaporizer.

6 Claims, 3 Drawing Sheets

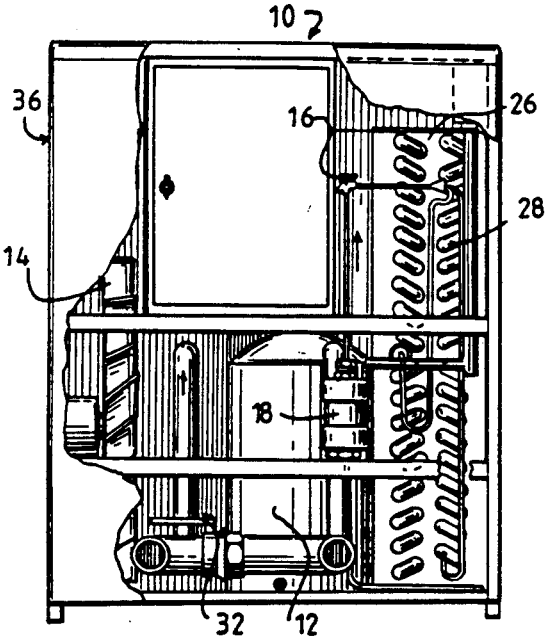
Fig. 3
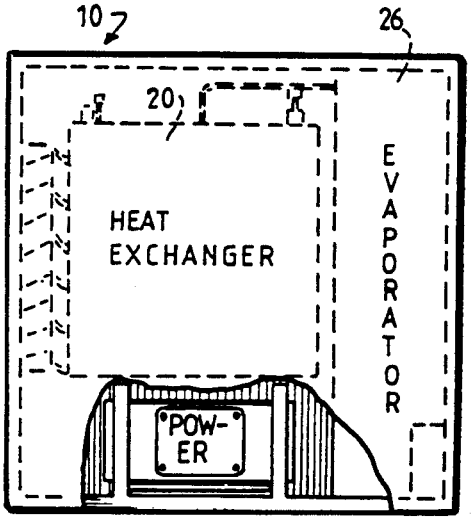
Fig. 4
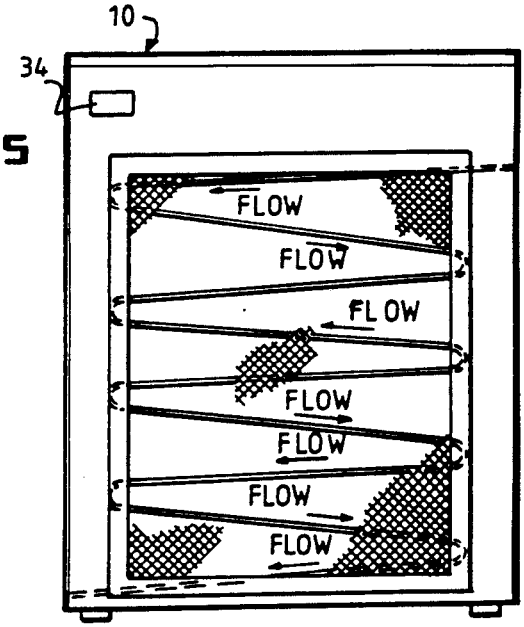
Fig. 5
Fig. 6
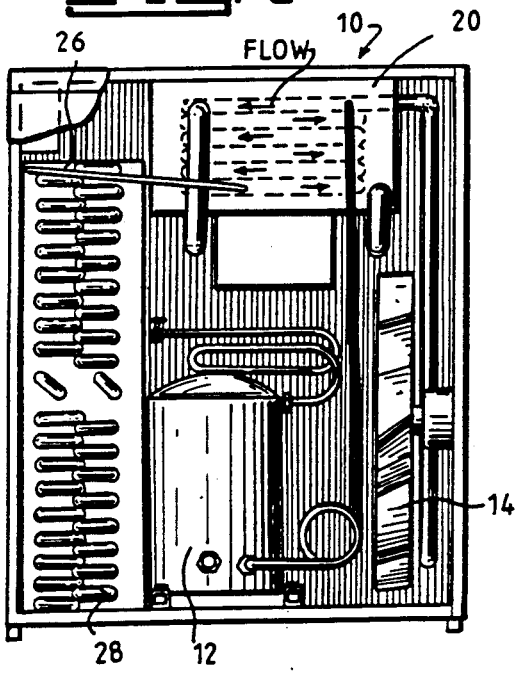
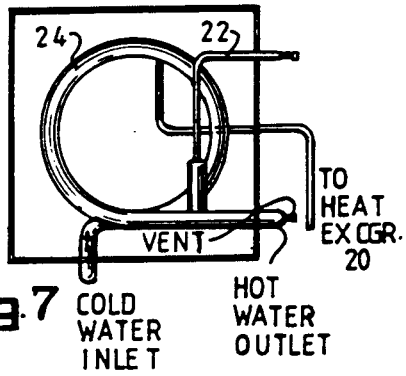
Fig. 7

AIR CONDITIONER HEATBOX

BACKGROUND OF THE INVENTION

1. Field of the Invention

The present invention relates to a heatbox.

More particularly, the present invention relates to a heatbox utilized for heating a swimming pool.

2. Description of the Prior Art

Numerous innovations for swimming pool heaters have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a heatbox that avoids the disadvantages of the prior art.

More particularly, it is an object of the present invention to provide a heatbox wherein the main benefit lies in its extremely low running costs as compared to other heating methods. Even though some power is needed to drive the heatbox, it is small compared to the heat it collects. The heatbox can produce up to 4 kW of heat for every 1 kW of electrical energy consumed. That is, four times as much energy as is paid for, or an efficiency rating of 400 percent.

Additionally, the heatbox is cleaner, requires no fuel storage, is generally quieter, and requires less maintenance than a conventional boiler.

In keeping with these objects, and with others which will become apparent hereinafter, one feature of the present invention resides, briefly stated, in a heatbox, comprising, a compressor having a discharge valve and a suction valve, a housing having a top and a bottom on to which the compressor is disposed, a mixed evaporizer having a bottom and a middle and being disposed vertically adjacent to the compressor in the housing, a fourth loop pipe connecting the evaporizer to the suction valve of the compressor, a fan disposed in the housing opposite the evaporizer, a heat exchanger having an input valve and being disposed near the top of the housing and above the compressor and having a third loop pipe connecting the discharge valve of the compressor to the input valve of the heat exchanger, a water expansion valve, a dryer having a top and a bottom to which a first pipe runs while a second pipe runs from the top of the dryer to the expansion valve, and a pair of fifth and sixth pipes connecting to the bottom and the middle of the evaporizer.

In accordance with another feature of the present invention, the fan includes seven blades and an electric motor rated at 240 volts.

Another feature of the present invention is that it further comprises a five Pound charge of R-22 refrigerant.

Yet another feature of the present invention is that the housing is steel.

Still another feature of the present invention is that the first pipe, the second pipe, the third looped pipe, the fourth looped pipe, the fifth pipe, and the sixth pipe are copper.

Yet still another feature of the present invention is that it further comprises an electric panel for receiving a thermostat and a bypass control.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 3 is a partial cross-sectional view of the left-side of the heatbox;

FIG. 4 is a partial cross-sectional view of the top of the heatbox;

FIG. 5 is a partial cross-sectional view of the front of the heatbox;

FIG. 6 is a partial cross-sectional view of the right side of the heatbox

FIG. 7 is a top view of the compressor; and

LIST OF REFERENCE NUMERALS UTILIZED IN THE DRAWING

Figure 1:
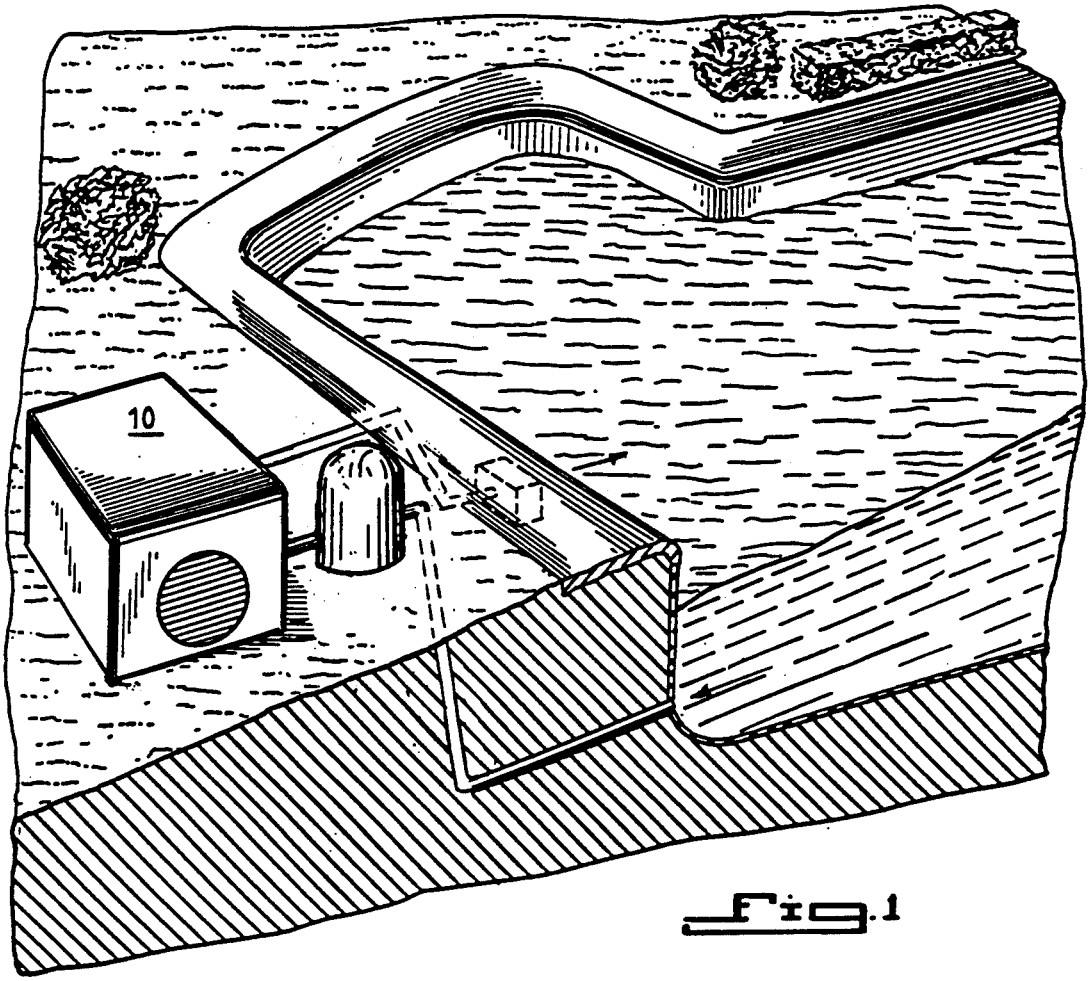
FIG. 1 is a top perspective view of the heatbox of the present invention being used to heat a swimming pool.
Figure 2:
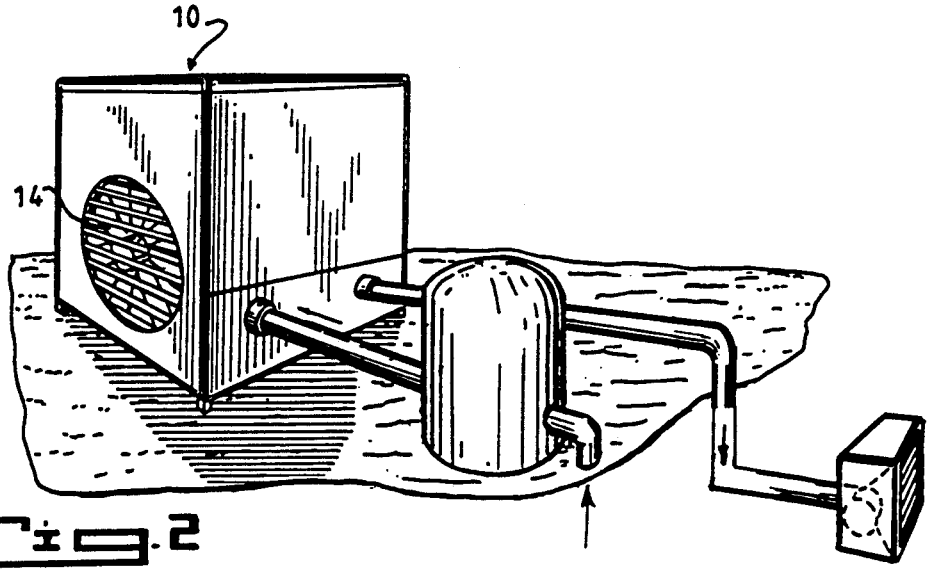
FIG. 2 is a front perspective view of the heatbox proper.
Figure 8:
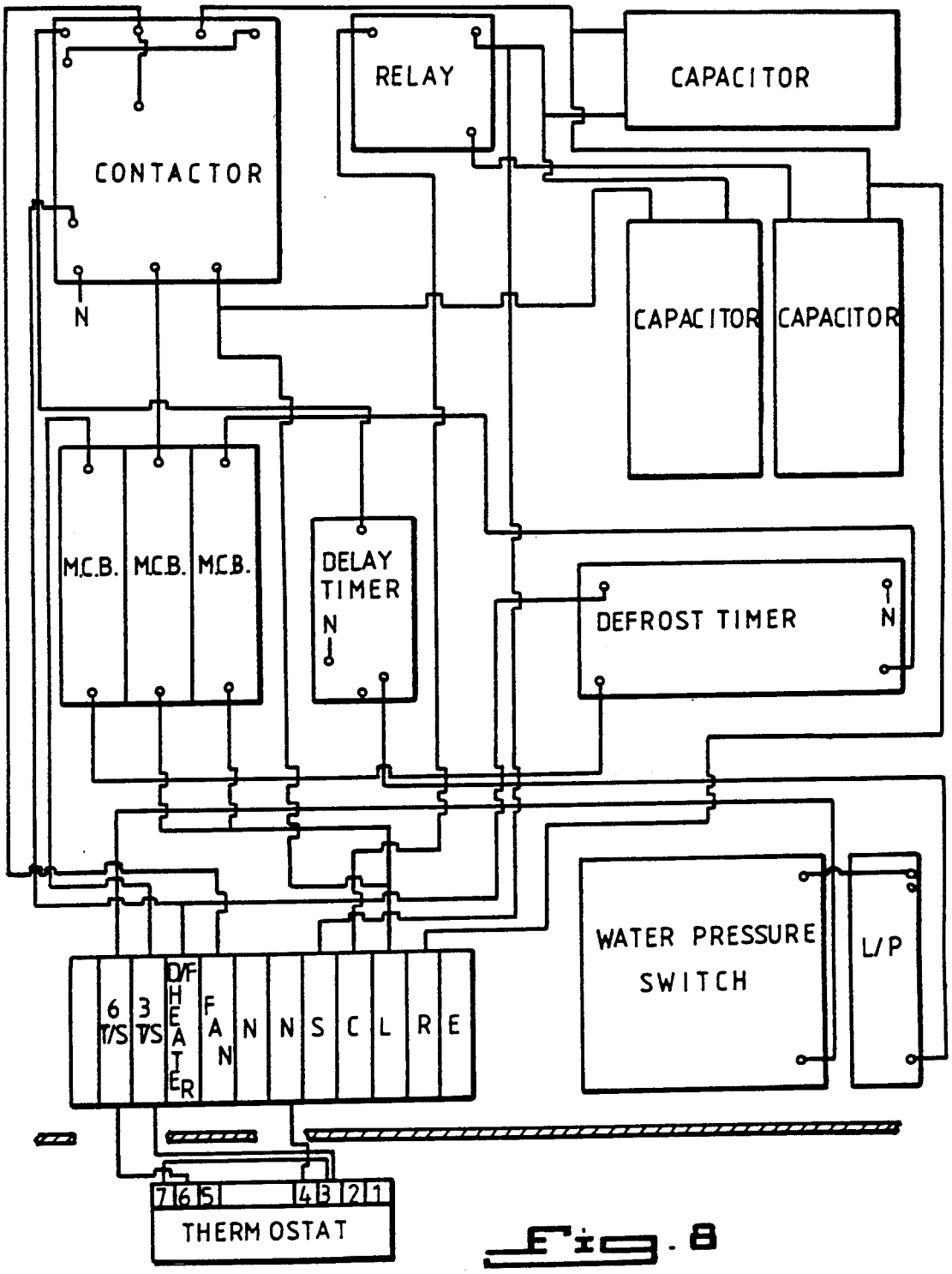
FIG. 8 is a schematic view of the heatbox of the present invention.

10 - one heatbox
12 - one electric compressor
14 - one seven blade fan with electric motor
16 - one expansion valve
18 - one dryer
20 - one heat exchanger
22 - ⅜" copper pipe
24 - ¾" copper pipe
25 - ¼" copper pipe
26 - evaporizer
27 - 1" copper pipe
28 - ½" copper pipe
29 - ⅝" copper pipe
30 - electric panel
32 - one 1½ inch bypass valve
34 - one thermostat
36 - one galvanized steel box
38 - bottom
40 - brackets
42 - top

DETAILED DESCRIPTION OF THE PREFERRED EMBODIMENT

In simple terms, a heatbox is a machine which works on a similar principle to that of a refrigerator. A heatbox is capable of extracting heat from a low grade heat source, such as the surrounding air. The surrounding air is concentrated and heated up to a more useful temperature. This upgraded useful heat can be made available as heated water.

The heatbox proper 10 of the present invention includes one electric compressor 12, one seven (7) blade fan with integral electric motor 14, one expansion valve 16, one dryer 18, one heat exchanger 20 comprising of a three-eighths inch copper pipe 22 disposed inside a three-quarter inch copper pipe 24, one mixed evaporizer 26 containing approximately two hundred feet of ½ inch copper pipes 28, one refrigerant R-22 with a charge of 5 pounds (not shown), one electric panel 30 with one expansion valve 16, one 1½ inch bypass valve 32, one thermostat 34, and one galvanized steel box 36 The power source for the heatbox 10 of the present invention operates on 240 volts.

The heatbox 10 is constructed by first placing the electric compressor 12 inside the galvanized steel box 36 on the bottom 38. Then the evaporizer 26 is placed vertically next to the electric compressor 12. The seven blade fan 14 is placed on the opposite side of the evaporizer 26 leaving approximately 2'9" between the seven blade fan 14 and the evaporizer 26. The heat exchanger 20 is fixed by means of brackets 40 near the top 42 of the galvanized steel box 36 above the electric compressor 12. Three-eighths inch copper pipe 22 is connected in a loop from the discharge valve of the electric compressor 12 to the heat exchanger 20 on the input valve.

A three-eighths inch copper pipe 22 runs from the top of the dryer 18 to the expansion valve 16 and is then connected to the bottom and middle of the evaporizer 26 by means of two one-quarter inch pipes 25. A one inch copper pipe 27 from the evaporizer 26 reduces to three-quarter inch pipe 24 is further reduced to five-eighths of an inch pipe 29 and, is then connected to the suction valve of the compressor 12 in a loop. This completes the circuit.

The heatbox 10 of the present invention can also be used for an outdoor swimming pool.

Siting of the heatbox 10 of the present invention is the first consideration. The heatbox 10 needs to be accessible but unobtrusive. Air flow to and from the heatbox 10 should not be obstructed as this will impair the performance. Six feet of clear air from the seven blade fan 14 is an adequate distance to prevent any recirculation.

Because the heatbox 10 of the present invention produces condensation, a need for a soak away is imperative. A trench 2" to 3" deep beneath the heatbox 10, filled with pea gravel, will suffice. If this is not practical then on the base of the heatbox 10 is fitted a drain pipe to which a plastic or copper pipe can be attached and piped to the nearest drainage point. When actually siting the heatbox 10 on its base, it must be ensured that the heatbox 10 is level to assist in the natural drainage from the heatbox 10.

Electrical installations should be carried out by a qualified electrician. A main insulator should be incorporated not more than two meters from the heatbox 10. The electric panel 30 is incorporated inside the heatbox 10. Cable glands at the bottom of the electrical box, are provided.

ELECTRICAL REGULATIONS REQUIRE THAT EITHER ARMOURED CABLE OR PYRO BE UTILIZED AS THE INCOMING SUPPLY CABLE.

Two 1½" bsp sockets are fitted on the side of the heatbox 10 to which flow and return from the filtration plant is attached. There is no requirement to incorporate a by-pass valve 32 because a by-pass valve 32 is already fitted internally.

A 10° C. differential across the heat exchanger 20 must be achieved. Temperatures are best taken on the copper flow and return pipes, just before they enter the heat exchanger 20. Adjustments on the by-pass valve 32 are made to achieve the required results, such as, a 10° C. differential across the heat exchanger 20.

First, check that there is satisfactory water flow through the heatbox 10. Then check that there is power to the heatbox 10. Switch in the MCB's inside the electric panel 30 and the heatbox 10 should start. If not, isolate and check the fault finding data.

Once the heatbox 10 has been started, it should be left running to heat the swimming pool. The heatbox 10 must remain constantly running until the swimming pool temperature has reached the pre-set level on the thermostat 34.

Under normal conditions, the swimming pool water will take up to seven days, depending on conditions to reach the desired temperature. Once the swimming pool has reached that temperature the thermostat 34 will automatically switch the heatbox 10 on and off to maintain the swimming pool at the pre-set temperature.

Should a higher swimming pool temperature than the pre-set temperature of 75° F. (24° C.) be required, unclip the transparent cover on the thermostat 34, and turn the knob on the right of the thermostat 34 to the temperature reading required. Replace the transparent cover immediately to form a water-tight seal over the thermostat 34.

Periodically, the heatbox 10 should be checked. this involves turning off the heatbox 10 at the main insulator, checking the air inlet grill and surrounding area, and removing any obstruction, such as leaves, etc. Wash off the area behind the grill, if dirty, leaving the heatbox 10 to stand for 10 to 15 minutes, and then switch on the power supply to restart the heatbox 10.

It is necessary to drain out the swimming pool at the close of each pool season. This will provide frost protection and reduce the risk of corrosion. The electric supply to the heatbox 10 is isolated. Fuses (external to the unit) are removed and kept in a safe place to prevent the accidental operation of the heatbox 10. The water circulation pump is switched off. Drain the water from the heatbox 10 by disconnecting the 1½" pipe fittings from the heatbox 10. Flush the water circuit for about 10 minutes with clean tap water through a hose into the top connection. Swimming pool water should not be used for this purpose. Allow the heatbox 10 to drain and cover with plastic bags secured over the water connections. Remove the lid and liberally spray the interior of the heatbox 10, including the seven blade fan with motor 14 and inside the electric box with a moisture repellent aerosol. Replace the lid. When the heatbox 10 is open to the elements, cover it with a ventilated cover but do not cover with plastic which will create condensation.

It is necessary to fill up the swimming pool at the beginning of each pool season. Remove any protective cover that has been fitted. Clear away any obstruction to the grill. Wash with tap water to remove any loose dirt or debris behind the grill. Remove the plastic bags on the 1½" water pipe connections and re-connect the water pipes. The water circulating pump is activated and continues running for at least 15 minutes to ensure full water flow and to drive out most of the air in the piping. To eliminate any remaining air remove the lid and the red cap on the copper stalk and depress the valve to release the air. Continue until the air has been eliminated and only water is emitted. Replace the fuses to the heatbox 10 circuit. Switch on the heatbox 10. Check that the central thermostat 34 is set to the required swimming pool temperature. Check at frequent intervals to ensure that the swimming pool water is at the correct P.H. and chemical levels.

The heatbox 10 of the present invention requires periodic maintenance service. To do this, remove all fuses before commencing work. Check all electrical connections, insuring tightness and cleanliness, remake any that look as though they have been overheating.

Check all plumbing connections. If any appear to have been weeping, re-tighten or remake. Check fixing bolts on the seven blade fan 14 and the compressor 12, tighten if necessary. Check the seven fan blades for any obstruction or bearing wear. Make sure the seven blade fan 14 spins freely. Wash out evaporator coil 26 With cleaning fluid, check suctions and discharge nuts for tightness and leaks together with the remainder of the system, rectify, if necessary.

Check electrical continuity on the defrost heaters, if fitted. Refill system with water following start up procedure. Once start up procedure has been completed, check incoming supply. If correct, replace fuses. Before switching on the heatbox 10, connect amp probe to check start and running current. Switch the heatbox 10 on making sure that readings are within 10–15% of specification. Check discharge and suction pressures. If excessively low or high, check system for leaks or blockage. Check air volume through heatbox 10 which should be within 5% of specification. Insure there is an 11° C. differential between flow and return on the internal heat exchanger 28. This should he checked after the heatbox 10 has been running for approximately thirty minutes. If the reading is not within 10% of the specification then adjust the bypass valve 32 until it falls within this range. Clean the outside casing of the heatbox 10 and touch up any area's that have been scratched or damaged.

It will be understood that each of the elements described above, or two or more together, may also find a useful application in other types of constructions differing from the type described above.

While the invention has been illustrated and described as embodied in a heatbox, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A heatbox, comprising:

a) a compressor having a discharge valve and a suction valve;

b) a housing having a top and a bottom on to which said compressor is disposed;

c) an evaporizer is disposed having a bottom and a middle and being vertically disposed next to said compressor in said housing and having a first loop pipe connecting said evaporizer to said suction valve of said compressor;

d) a fan disposed in said housing opposite said evaporizer;

e) a heat exchanger having an input valve and being disposed near said top of said housing and above said compressor, said heat exchanger having a second loop pipe connecting said discharge valve of said compressor to said input valve of said heat exchanger;

f) one expansion valve; and g) a dryer having a top and a bottom to which a third pipe runs while a fourth pipe runs from said top of said dryer to said one expansion valve and a pair of fifth and sixth pipes connecting to said bottom and said middle of said evaporizer.

2. A heatbox as defined in claim 1, wherein said fan includes seven blades and an electric motor rated at 240 volts.

3. A heatbox as defined in claim 2, further comprising a five pound charge of R-22 refrigerant.

4. A heatbox as defined in claim 3, wherein said housing is steel.

5. A heatbox as defined in claim 4, wherein said fourth pipe, said third pipe, said second looped pipe, said first looped pipe, said fifth pipe, and said sixth pipe are copper.

6. A heatbox as defined in claim 5, further comprising an electric panel for receiving a thermostat and a bypass control.

* * * * *